US006027608A

United States Patent [19]

Gassner

[11] Patent Number: 6,027,608

[45] Date of Patent: Feb. 22, 2000

[54] CONVERSION OF AVIAN FEATHER-WASTE STREAM TO USEFUL PRODUCTS

[75] Inventor: George Gassner, Prince George, Md.

[73] Assignee: Origin Technology, Inc, Laurel, Md.

[21] Appl. No.: 09/266,820

[22] Filed: Mar. 12, 1999

Related U.S. Application Data

[60] Provisional application No. 60/103,273, Oct. 6, 1998, and provisional application No. 60/106,562, Nov. 2, 1998.

[51] Int. Cl.[7] ..... D01B 10/00; D01C 3/00; D21C 9/02; B03B 5/66

[52] U.S. Cl. ..... 162/2; 162/1; 162/60; 162/72; 162/78; 162/151; 209/157; 209/173

[58] Field of Search ..... 209/157, 173, 209/176, 177; 162/1, 2, 60, 72, 78, 151

[56] References Cited

U.S. PATENT DOCUMENTS 3,475,112 10/1969 Mahall ..... 8/94.1
3,607,621 9/1971 Wasko et al. ..... 162/135
4,169,706 10/1979 Kruchen ..... 8/94.1
5,053,082 10/1991 Flanigan ..... 134/25
5,705,030 1/1998 Gassner et al. ..... 162/2

*Primary Examiner*—Donald P. Walsh
*Assistant Examiner*—Daniel Schlak

[57] ABSTRACT

A process for converting components of poultry production feather waste into value-added products involves a single counterflow or batch system wash in a polar organic solvent solution. The feather waste can contain loose, picked feathers, and non-feather avian parts. The feather-waste stream is exposed to a concentration gradient of solvent which sanitizes, denatures, dehydrates, and de-oils it. In one aspect, the counterflow contact between solvent solution and feather waste takes place in an inclined screw conveyor. The process produces avian oil and protein from a liquid intermediate stream and dry fiber and protein powder from the converted waste stream. Fiber from this process can be used in fabrics, composites, extrusions and laminates. Oil and protein can be used in biochemical, pharmaceutical, cosmetic, animal feed, and fertilizer products.

20 Claims, 1 Drawing Sheet

CONVERSION OF AVIAN FEATHER-WASTE STREAM TO USEFUL PRODUCTS

This application claims benefit of provisional application Ser. No. 60/103,273 filed Oct. 6, 1998, and claims benefit of provisional Application Ser. No. 60/106,562 filed Nov. 2, 1998.

FIELD OF THE INVENTION

This invention relates to processes for converting components of avian feather waste streams to fiber, protein, and oil. More specifically the invention relates to processes for converting avian feathers or a mixture of avian feathers and non-feather avian parts in either a single continuous counterflow or batch system wash, to products for diverse applications.

BACKGROUND AND SUMMARY OF THE INVENTION

Consumption of poultry in the United States and elsewhere has resulted in a substantial increase in waste products for disposal by poultry producers. In addition to feathers, components of the feather-waste stream include avian parts such as heads, wings, feet, and the like, collectively referred to as "avian parts or non-feather avian parts", are a significant part of the feather-waste stream. Commercial poultry producers lose a considerable part of their harvest during the feather-picking operation. Efficient recovery of this loss in not known to the art.

Disposal of the mixture of feathers and avian parts from the picking process is expensive and difficult. For example, poultry waste is burned or buried. These methods are environmentally unsound and restricted. A more expensive disposal method for poultry waste uses hydrolysis to produce a low-quality protein animal feed for which demand is low; it sells for a break-even cost or a loss. Beyond animal feed, there are no reports of commercially useful products manufactured from feather waste.

Recent strides have been made to develop processes for making a useful fiber material from feather waste in a commercially viable manner. Such processes present to poultry producers the ability to reduce waste disposal costs and to gain a profit from feather waste. Additionally, the conversion of feathers to fiber offers a more environmentally benign solution for feather disposal than former methods. Still further, it has been proposed to use the fiber recovered from feathers to produce articles that would otherwise usually be made of environmentally depleting resources or be made by methods that are more detrimental to the environment. An example is paper. Making fiber from feather waste provides less harmful alternative products and processes and thus generates benefits outside the poultry production industry as well as within.

Significant developments toward producing fiber from raw feathers were disclosed using the batch system described in U.S. Pat. No. 5,705,030, hereafter referred to as '030, the entire disclosure of which is hereby incorporated herein by reference. The '030 patent teaches a method comprising five essential steps, namely, (1) collecting raw feathers, (2) washing said feathers in a polar, water-soluble organic solvent, (3) repeating said washing step, (4) removing solvent from said feathers, and (5) removing fibers from feather shafts. It uses only one of the components from the feather waste stream, raw feathers.

Although the '030 patent represents an advance in the art, room remains for improvement. For example, the patent calls for washing the feathers two separate times in an organic solvent and does not include a closed continuous counterflow wash system. Reducing the amount of washing reduces operating costs and risks of environmental exposure to the solvent. It is desirable to reduce the amount of washing and thereby further reduce operating costs and risk of hazard from environmental exposure to the solvent.

The methods of stripping feathers from birds in poultry production often referred to as "picking" is of great practical significance to commercially successful conversion of feathers to fiber. In a typical feather picking unit operation, suspended bird carcasses are repeatedly struck by numerous, high-speed, flexible, finger-like beaters. In addition to feathers, the striking action frequently pulls parts from the birds, such as heads, necks, feet, and the like. These non-feather parts can not be returned to production and thus represent a substantial poultry production yield loss. Also, non-feather avian parts are usually combined with, and thus contaminate the feathers. This can render the feathers unusable, for example, because as mentioned, the '030 patent process calls for making fibers only from raw feathers. A process for converting feathers to fiber that can use raw feathers mixed with non-feather avian parts eliminates expensive manual or mechanical devices required to produce raw feathers specified in the '030 patent.

When avian parts are left in the feather waste stream, the yield of fiber, protein, and oil is maximized and the environment is relieved of unwanted nitrogen. Furthermore, a process which produces more fiber, protein, and oil is highly desirable.

Consequently, there is now provided according to this invention a process for converting components of a feather-waste stream to fiber, protein, and oil comprising the steps of (a) contacting with a solvent said components selected of the group consisting of feathers and a mixture of feathers and avian parts from the feather-waste steam;
(b) maintaining contact of said components of the feather-waste stream with the solvent;
(c) drying said components of the feather-waste stream;
(d) shredding and comminuting said components of the feather-waste stream; and
(e) classifying the shredded and comminuted said components of the feather-waste stream.

This invention also provides the process for converting feathers and mixtures of feathers with other avian parts to fiber, protein, and oil comprising the steps (a)–(e) set forth above with the advantageous feature that only a single contact of the feather-waste stream with solvent is called for. Therefore, the two washing steps disclosed in the prior art can be condensed to one.

An important advantage of this invention is the solvent gradient which washes the feather-waste stream to make substantially completely devoid of residuals, impurities, and potentially detrimental microorganisms.

Another advantage of this invention is that the fiber product can be classified according to size to provide selected fiber fractions. The fiber fractions can be optimized for various end uses such as: filters; wovens and non-wovens; extrusions, laminates, and composites; fillers and insulation; packing and adsorbents; paper-like products; biodegradable horticultural pots, mats, and other matrices thereby increasing the value of the fiber product.

Protein and avian oil products, sometimes collectively referred to herein as "residuals", are also generated by the novel process. Upon subsequent processing, these residuals can be made into or be incorporated in useful products such as biochemical reagents, pharmaceuticals, cosmetics, animal feed and fertilizer. The added value of powdered protein obtained from residuals in accordance with the novel process will be high as a result of contribution from non-feather avian parts in the feather-waste stream. Consequently, the economic value of the powdered protein will be greater than heretofore produced by prior art processes in which only raw feathers are used.

There is further provided an apparatus useful for carrying out the process of this invention.

Thus, it is a primary objective of this invention to eliminate the expense and difficulty of removing non-feather avian parts from a poultry production feather-waste stream to produce raw feathers.

It is another objective to provide a continuous, counterflow process for converting the feathers-waste stream to fiber, protein, and oil that employs only a single contact of the feather-waste stream with an organic solvent.

It is yet another objective to provide a process for converting the feather-waste stream to fiber, protein, and oil that uses energy and solvents more efficiently than prior art methods. For example, little or no solvent is lost to the atmosphere from the closed system. Waste from solvent reclamation can be used as an energy source to generate heat, for drying, distillation, and the like.

Still a further objective is to provide a process for recovering a larger quantity of powdered protein from conversion of feathers to fiber than in prior art.

Another objective is to provide fiber, protein, and oil which have value in diverse utilities.

Additionally, it is an objective to recover significant products lost from commercial avian waste streams.

Accordingly, the advantages of this invention are it:

(a) accepts both avian feathers and a mixture of avian feathers and other avian parts;
(b) eliminates the expense and difficulty of manual or mechanical removal of avian parts to produce raw feathers;
(c) uses only a single contact with a water soluble organic polar solvent;
(d) uses a lesser total quantity of extraction solvents than previous methods;
(e) provides more efficient energy use than previous methods;
(f) provides for more complete recovery of fiber, oil, and protein than previous methods;
(g) channels avian parts from the waste stream to valuable end uses for novel products;
(h) diverts unwanted nitrogen waste from the environment;
(i) can restore a significant product loss from commercial avian processing operations.

Therefore, the instant invention provides efficient procedures and useful products while solving an environmentally sensitive problem of waste disposal.

Figure 1:
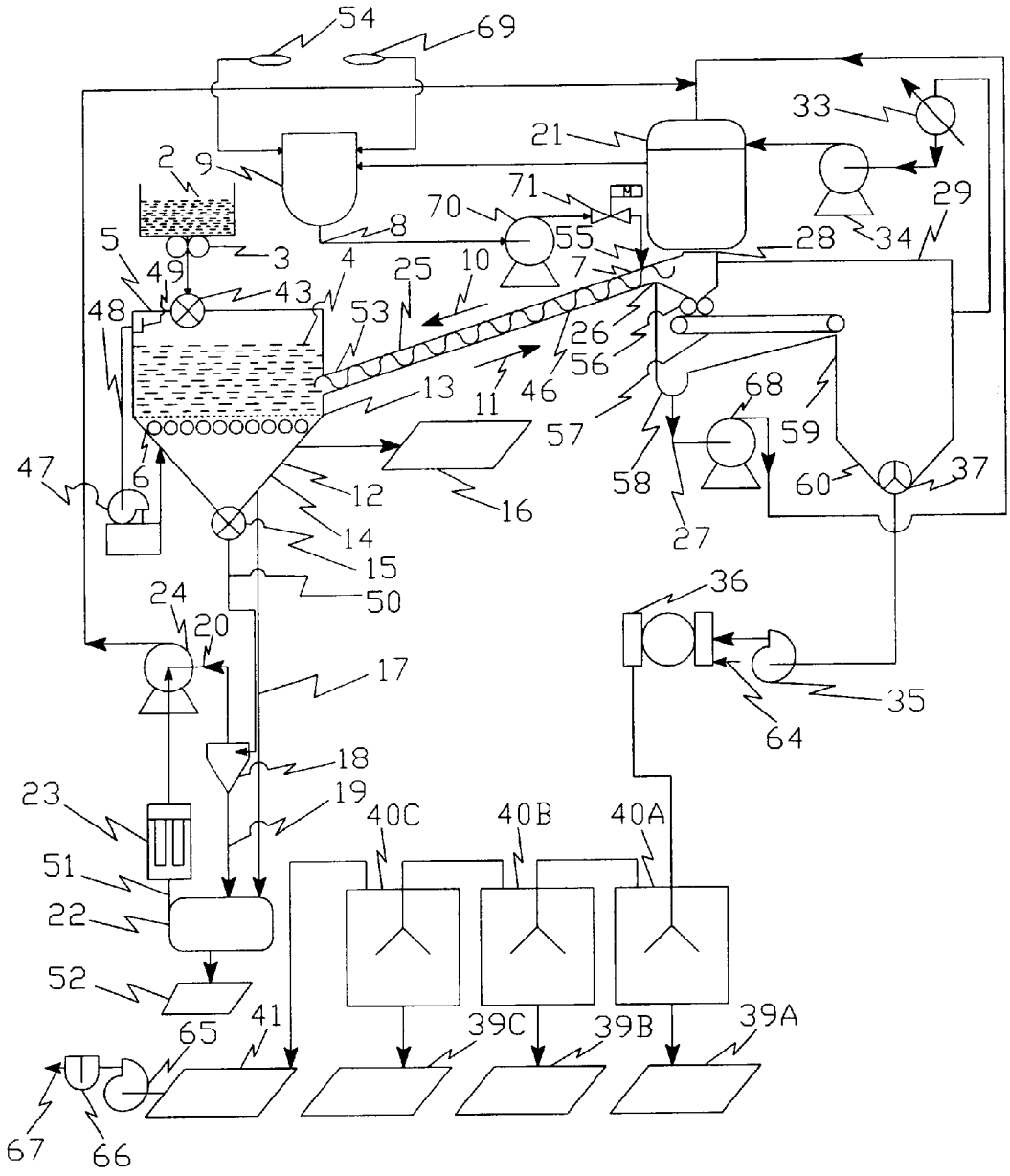
FIG. 1 is a schematic flow diagram of a preferred embodiment of the novel process.

| REFERENCE NUMERALS FOR FIG. 1 |
|---|
| 2 feather waste stream |
| 3 nip system for receiving feathers from picker |
| 4 zone of initial contact, 65–75% vol solvent |

-continued

| REFERENCE NUMERALS FOR FIG. 1 |
|---|
| 5 receiving hopper |
| 6 stirring device or airburst manifold |
| 7 upstream end of counterflow system, 80–95% vol solvent |
| 8 recycled solvent |
| 9 solvent reservoir |
| 10 flow direction of fresh solvent |
| 11 flow direction of the feather-waste stream |
| 12 spent solvent |
| 13 mesh sieve plate to separate oil and particulates from solvent |
| 14 decanter system |
| 15 metering valve |
| 16 oil |
| 17 decanted protein |
| 18 cyclone separator |
| 19 solvent underflow stream |
| 20 solvent overflow stream |
| 21 solvent recovery unit |
| 22 slurry dryer |
| 23 condenser |
| 24 solvent recovery pump |
| 25 counterflow treatment vessel |
| 26 feather waste stream outlet |
| 28 filter unit |
| 29 dryer |
| 33 condenser |
| 34 pump |
| 35 blower |
| 36 converter |
| 37 metering valve |
| 39 A, B, C fiber fractions |
| 40 A, B, C fiber classifiers |
| 41 protein powder |
| 43 metering valve |
| 46 inclined screw conveyor |
| 47 blower |
| 48 air from vapor space |
| 49 baffle |
| 50 slurry |
| 51 residual liquid |
| 52 protein product |
| 53 lowest screw flight |
| 54 solvent tank |
| 55 high concentration solvent charge |
| 56 nip rollers |
| 57 conveyor |
| 58 dryer unit sump |
| 59 dryer discharge |
| 60 hopper |
| 64 ambient air intake |
| 65 blower |
| 66 air scrubber |
| 67 scrubbed air outlet |
| 68 pump |
| 69 diluents tank |
| 70 pump |
| 71 flow control valve |

DETAILED DESCRIPTION

The novel process can be understood with reference to FIG. 1.

It is a recognized artifact of present day poultry production that the de-feathering units often remove feet, legs, wings, heads, necks, and the like in addition to raw feathers. Feathers often remain attached to these pieces. Such pieces, whether free of or with attached feathers are collectively referred to herein as "avian parts or non-feather avian parts". Another great advantage of the present invention is that the novel process is able to convert the avian parts simultaneously and in intimate mixture with raw feathers, as will now be explained. The mixture of feathers and avian parts is referred to herein as "feather-waste stream".

The feather-waste stream 2 from the picker is crushed between one or more pairs of rolers hereinafter called "nip system" 3. The nip system rollers squeeze the feather-waste stream in the manner of a mangle. The nip system is adjusted to define the maximum thickness of the waste stream, squeeze it to near dryness, and crush it to a uniform mat of 2–5 cm. If multiple pairs of nip rollers are employed, they may be set to different, preferably increasingly smaller distances, to make the parts more accessible to organic solvent during subsequent processing. Therefore, the nipping step facilitates the sanitizing, denaturing, and dehydrating steps to follow.

The nipped feather-waste stream moves into the zone of initial contact 4 at the low end of the counterflow wash vessel. In this vessel the feather-waste stream begins a treatment to remove oil and some protein as well as to sanitize and dehydrate it. The feather waste is agitated in receiving hopper 5 by a stirring device or preferably a pulsed air burst system 6. At the zone of initial contact the feather-waste stream is totally immersed in a solution comprising water and a water soluble polar organic solvent mixture. This mixture is comprised of a 65–75 vol %, preferably about 70 vol %, water soluble polar organic solvent, preferably ethanol. Preferably, the vessel has liquid and vapor tight seals to isolate the contents from ambient atmosphere thereby preventing volatiles from escaping to the environment. The wash stream consists of a gradient with a high-concentration upstream end 7 where about 80–95 vol %, preferably about 90 vol % of recycled solvent 8 is added to the wash system from reservoir 9.

Preferably, the fresh solution is admitted at a position distant from the zone of initial contact so as to flow in a direction represented by arrow 10 opposite to the direction of flow of the feather-waste stream arrow 11. The gradient profile and opposite direction flow of the solution and the feather-waste stream thus defines the signature feature of the counterflow process.

The use of a counterflow system and devices for washing other materials such as: oil-contaminated drill cutting solids; hydrocarbons from water; mineral oil from polyethylene; and oil from oil seeds is well known and within the level of ordinary skill in the art. However, unexpectedly, a counterflow process can be effective for washing feather waste in a continuous stream as part of the current invention. Counterflow is an important aspect of this invention. and may be utilized with little or no modification in known procedures.

The spent solvent 12 is discharged from the treatment vessel near the zone of initial contact. This stream primarily comprises a solution of organic solvent that has been diluted by liquid that arrived with the feather-waste stream, such as water, blood, oil, and the like. It additionally contains some particulates from the feather-waste stream.

The spent solvent passes through a 4 to 5 mesh sieve plate 13 into a decanter system 14 which draws off top liquid without disturbing sediment or lower liquid layers. The decanter system is connected integrally to the downstream end of the water soluble polar organic solvent flow. By way of a control valve 15, the slurry may enter another one or more decanters which collect oil 16 and protein 17. Following decantation, the slurry 50 is pumped to cyclone separators 18 where remaining protein enters an solvent underflow stream 19. The solvent overflow stream 20 continues to refinement in the solvent recovery unit 21. Reboiler residue is used to generate heat for drying, distillation and the like. The decanted proteins 17 and proteins from the underflow stream are collected following evaporation of the solvent in dryer 22. The solvent is condensed in condenser 23 and moved through pump 24 to the solvent recovery unit 21 to be reclaimed and fed into the solvent reservoir 9.

Feathers and avian parts move through the solvent stream in the counterflow vessel 25. The wash time in the vessel is dependent on the ratio of feathers to avian parts. An increase in avian parts in the counterflow stream requires an increase in the time the feathers and avian parts are maintained in the counterflow solvent stream. For example, typical resident times can be about ten minutes to an hour in the 65–75 vol % solvent zone of initial contact 4 or the time required for microbiological quality control assay to indicate a safe microbial count level. Typical exposure times can be about ten minutes to an hour in the 80–95% solvent zone 7 or the time required to denature and dehydrate protein. Bacterial agents such as a sodium azide solution can be added to the stream. A surfactant such as polysorbate 80® may also be included in the wash solution at about 0.5 vol %. The spent solution is discharged from the treatment vessel near the zone of initial contact. This stream primarily comprises solution of organic solvent that has been diluted by liquid that arrived with the feather-waste stream, such as water and oil. It additionally contains fine particles of protein that have sloughed off from the avian parts.

Upon reaching the outlet 26 of the counterflow vessel, excess solution 27 is removed from the waste feather stream by a filter unit 28. Excess solution is sent to the solvent recovery system. The filter unit can be any conventional type of filter made to remove supernatant liquid from the feathers and denatured, dehydrated protein. A preferred filter unit comprises one or more pairs of nip rollers that squeeze the feather-waste stream and prepares it for drying. Excess solution is sent to the solvent recovery unit 21.

The damp feather-waste stream next passes into dryer 29 for near complete removal of remaining moisture. Many types of drying equipment well known in the art are suitable for this operation. For example, the feather-waste stream can be carried on a conveyor belt through a heated oven. Optionally, a dry sweep gas or vacuum can be used to enhance drying. Freeze drying is another acceptable drying technique.

Generally, liquid residue in the damp feather-waste stream is volatilized to vapor then condensed to a liquid in condenser 33. The condensed liquid residue also passes through pump 34 to the solvent recovery unit 21.

Before conversion he feather-waste stream can be fed through alternate embodiments not illustrated such as mulchers, shredders, or choppers to shorten feathers and reduce the size of the parts, thereby increasing the speed and the efficiency of the conversion. The feather-waste stream at the discharge of dryer 59 moves through blower 35 into the converter 36 to pulverize the avian parts to powder and remove fibers from the feather quill using mechanical shredding or shearing. Conversion can be accomplished by nills, pulverizers, grinders, or disintegraters. Fiber length and protein particle size criteria determine which conversion devices should be used. The dried feather waste stream should be metered to the converter with a device such as the illustrated valve 37 to avoid surging which can disrupt continuity in the converter and adversely affect the separation process.

The converted product has a dry, free flowing particulate consistency. It comprises two basic components, namely, a fiber component and finely ground protein powder. Fiber in the converted product can be separated into a plurality of different fiber length fractions 39A, 39B. 39C utilizing one or more classifiers 40A, 40B, 40C. Finely ground protein powder 41 can be isolated from classification and collected for use as an additional value-added product. Various well known classifying machines can be used to separate the fiber and powder products. For example, elutriators, vibrating screen conveyors, cyclone separators and combinations of these can be used.

A preferred embodiment of the novel process can be understood with reference to FIG. 1. The feather-waste stream 2 from poultry producers including feathers and other avian parts are dropped onto nip roller system 3 which crush the feather waste stream and flatten the avian parts. Then the crushed feather-waste stream is fed by metering means 43 to the initial contact zone 4 in a receiving hopper 5 of the counterflow solvent treatment vessel 25. The metering means can be any conventional device for admitting the wet stream of solids into the tank at a controlled rate. For example, the metering means can be a rotary valve, a gear pump, a screw pump, a vibrating belt, roller conveyor, or a combination of these. The receiving hopper contains solvent solution which is maintained at a level above mesh sieve plate 13, and preferably, above the entrance to the inclined screw conveyor 46. Feather waste thus descends to the mesh sieve plate immersed in solution while it awaits being withdrawn via the screw conveyor.

Pulses of air supplied by blower 47 is directed upwards from under the mesh sieve plate 13 via air burst manifold 6. These air bursts serve to prevent solids from blocking the mesh sieve plate and to agitate the feather waste in the solvent thereby promoting the denaturing, sanitizing, dehydrating, and deoiling of the feather waste. The agitation also fluidizes the feather waste and disperses the pieces of the waste in the solution so that the feathers and avian parts can come within proximity to the flights of the screw conveyor and are thus withdrawn by the screw 46.

Ambient air can be used for operation of the air burst manifold, however, such a scheme would require venting of an equal amount of air emissions saturated with solvent elsewhere in the system. As shown in the preferred scheme, air is taken from the vapor space 48 above the solution in the recieving hopper 5. This maintains the air within the receiving hopper and avoids the need to vent large amounts of solvent-laden air to the atmosphere. Although a pulsed air flow is preferred, steady air flow is also acceptable. To reduce the amount of liquid entrained in the recirculating air, the air intake is preferably positioned behind a baffle 49. The term "air" is used liberally to describe the gas circulating through blower 47 more accurately contains solvent and vapor of other liquid components present in solution. Oxygen and nitrogen may actually be a minor fraction of the recirculating "air". The air burst manifold can be constructed of a network of tubes with mutltiple upward directed vents or nozzles positioned so as to agitate a large area of the mesh sieve plate.

The recieving hopper 5 is further provided with a decanting system 14 below the air burst manifold 6. Liquid and fine protein particles descend into the decanting section. In contrast to the agitated state of the suspension above the screen, the liquid in the decanting section is maintained in a quiescent state which allows formation of an oil rich phase in a layer above an aqueous solution layer.

An avian oil product 16 from the oil rich phase can then be selectively withdrawn using conventional decanting equipment. The oil rich phase can be collected as is or further processing may be desirable depending on intended use of the product. For example, the oil rich phase can be filtered to remove solids that might occur despite filtration through the mesh sieve plate, or refined to separate an equilibrium concentration of solvent. Traditional methods well known in the art can be used to accomplish optional refinement of the oil rich phase. It is important that the agitation of the feather waste above the mesh sieve plate 13 does not interfere with the decanting step performed below. Impact of the agitation on decanting can be reduced by carrying out decanting in a separate vessel in an alternate embodiment not illustrated.

The slurry 50 of fine protein particles in aqueous solution can be metered via valve 15 to a unit for separating the protein from the liquid. In the illustrated embodiment, the slurry is directed to a cyclone separator 18 which operates to produce a solvent overflow 20 primarily of solvent and protein particles solvent underflow 19 from the cyclone separator to a dryer 22 in which residual liquid 51 is volatilized and removed leaving a dry particulate protein product 52. Vapor from the dryer can be reliquified in a condenser 23 and the liquid combined with liquid recovered from the cyclone separator. The combined liquid then can be directed to a solvent recovery unit 21 for salvage and reuse of the solvent.

As depicted in FIG. 1, the counterflow section of the feather waste treatment vessel includes an inclined screw conveyor 46. Pieces of feather waste dispersed in the solvent solution are taken into the lowest screw flights 53 of the screw conveyor which extend into the receiving hopper portion of the treatment vessel. As the screw turns, it moves the feather waste up the incline in a continuous stream. The zone of initial contact 4 for the nipped feather-waste stream in the counterflow wash contains a 65–75 vol %, preferably about 70 vol %, water soluble polar organic solvent. The wash stream consists of a gradient with a high-concentration upstream end 7 where about 80–95 vol %, preferably about 90 vol % of a mixture of fresh and recycled solvent 8 is added to the wash system from a reservoir 9. Solvent lost is replenished from solvent tank 54 and diluent tank 69. High concentration solution is admitted at a position distant from the zone of initial contact so as to flow in a direction represented by arrow 10 opposite to the direction of flow of the feather waste stream represented by arrow 11. High concentration solvent solution 55 is charged into the screw conveyor near the topend. Due to the incline, the solvent flows downward through the conveyor and thus washes the feather waste countercurrently. As the most concentrate solution encounters feather waste, it removes fluid from the waste which dilutes the solution as it descends the conveyor. This establishes the concentration gradient between the high concentration of the fresh and recycled solvent 8 and of the solution in the initial contact zone 4.

Process variables such as the dimensions of the screw conveyor and operation of countercurrent flow in the conveyor should be selected to permit substantially complete dehydration, denaturing, and sanitizing of the feather waste by the time the waste reaches the top of the screw conveyor. Preferably the screw should be about 5–10 meters long, about 30–50 cm or greater in diameter, and the pitch of the screw flights should be two times the length of the longest feather. The angle of inclination should be about 15 to 60 degrees above horizontal and the screw should run at about 10–50 revolutions per minute. To accelerate the denaturing and sanitizing processes, temperature in the screw conveyor optionally can be controlled at ambient or elevated temperatures. Conventional methods of temperature control can be utilized.

The feather waste continues up the conveyor beyond the point of introduction of solvent in the feather waste stream outlet 26 that allows excess surface liquid to drain down the conveyor. Upon reaching the top of the screw conveyor, the dehydrated, denatured, sanitized, damp feather waste overflows into filter unit 28 and falls onto nip rollers 56. The feather waste is squeezed through the nip rollers to express residual liquid. This wet feather waste drops onto a moving endless belt conveyor 57 to be carried through a dryer unit 29. Preferably, the belt is perforated to allow free flowing liquid to drain through the belt to sump 58. Optionally, the belt conveyor can be inclined to facilitate drainage of flowing liquid backward and off the belt. The incline should not be so great as to cause excessive amount of solids to fall into the sump.

The dryer unit can be operated under vacuum, heat, or by other conventional methods, as previously mentioned, to remove volatile liquid from the feather waste. Drying conditions should be selected to provide a substantially completely dry feather waste product at the end of the conveyor belt. Although a single dryer and belt are illustrated, it is contemplated that multiple dryer units operated in series may be needed to substantially completely dry the feather waste. The feather waste at the dryer discharge section 59 should have a volatiles content of less than about 1.0 wt %, and preferably, less than about 0.5 wt %.

After attaining satisfactory dryness, the feather waste falls from the belt conveyor into hopper 60 at the dryer discharge section. From this hopper the dry feather waste moves to a converter 36 which removes fiber from quills and pulverizes avian parts using a high speed production size Waring Blender-type converter. The dry feather waste steam is metered to the converter at a control rate with a metering valve 37 to avoid surging in the converter.

The fiber and protein powder mixture is withdrawn from the converter through a series of classifiers 40A, 40B, 40C which segregate the fiber into product fractions of preselected size. Air elutriating classifiers, well known to the art, are preferred for use in this application. Basically, in air classifiers the inlet tube of each air classifier can be adjusted vertically within its concentric casing to modify the aerodynamics of the particle laden carrier gas so as to provide optimum classification of particles. That is, generally larger, heavier particles fall to the bottom of the casing and lighter, smaller particles get carried upward into the annular space surrounding the inlet tube within the casing and are discharged overhead from the classifier. The number and adjustment of classifiers is selected so that fibers are substantially completely segregated from powdered protein product 41 which is collected at the discharge of the last classifier.

Conventional equipment and procedures can be utilized to operate the classification system, as for example by drawing a stream of ambient air 64 into the converter, through the classifiers, and discharging the air via blower 65. A conventional air scrubber 66 may also be desirable at the scrubbed air outlet from the classifiers if the grinder product contains residual volatile organic components which should not be vented to atmosphere. Preferably, nearly all volatile organic components will be removed from the feather waste in the dryer and captured by the solvent recovery system which will now be described.

Organic compounds, primarily solvent, will be generated at numerous steps in the conversion process. This material is collected and recovered for reuse so as to avoid excessive environmentally hazardous air emissions as well as to reduce the cost of raw materials, i.e., fresh solvent. Excess liquid 27 from the dryer sump passes through pump 68 to a solvent recovery unit 21. Volatile organic components evolved from the dryer are condensed to liquid by condenser 33 and pass through pump 34 to the solvent recovery unit. Also the solvent-bearing vapor from decanter protein product is condensed by condenser 23 and moves through pump 24 with the cyclone separator overflow solution to solvent recovery. The solvent recovery unit is a conventional equipment subset primarily involving distillation processes to produce a recycle stream 7 of usable solvent solution. The recycled solvent solution is collected in reservoir 9 where it can be mixed with make-up solvent from tank 54 or diluents from tank 69 such as water to provide the desired solution concentration to charge the counterflow solvent treatment vessel. Accordingly, the concentrate solvent solution is moved through pump 70 through flow control valve 71 into the inclined screw conveyor. The feather waste for use in this process can originate from any type of avian species.

The solvent solution employed in connection with the novel process includes a water soluble polar organic solvent, preferably present in a diluent, especially water. Preferably, the solvent is a volatile alcohol having from one to about seven carbon atoms and can be aliphatic, cyclic, and aromatic. Exemplary of such alcohols are alkyl, alkenyl, aryl, cycloalkyl, aralkyl alcohols, and the like. Examples include, but are not limited to, the following: methanol, ethanol, propanols, butanols, pentanols, hexanols, heptanols, octanols, nonanols, decanols, and the like. Ethyl alcohol is especially preferred. Solvent solution can also include generally minor fractions of additives such as surface active agents, defoamers, and bactericide.

EXAMPLES

Example 1

Preparation of Fibers

The avian feather-waste stream is treated in a continuous counterflow system to remove oil and some protein as well as to sanitize, denature, and dehydrate it in a gradient counterflow stream of water soluble polar organic solvent. The wash time in about 80 to 95% ethanol is dependent on the ratio of feathers to parts. An increase in avian parts in the counterflow stream requires a decrease in the rate that the feathers and parts move through the counterflow solvent stream. For example, the exposure time would be equivalent to an exposure of ten minutes to an hour in a 70% ethanol solution or the time required for microbiological quality control assay to indicate a safe microbial count level. Bactericidal agents (e.g., a sodium azide solution) can be added to the stream. In addition, a surfactant such as polysorbate 80 may also be included in the wash solution at about 0.5% (v/v). Subsequently, the mixture of avian feathers and parts are dried, shredded in a Waring Blender-type converter, air classified and packaged for use.

Example 2

Preparation of Fiber Pulp

Dilute 5 g commercial casein glue (Elmer's Glue, Borden Co. Columbus. Ohio) with 5 g water and mix with 10 g ethanol. Sonicate the solution to remove air bubbles and mix with 10 g fibers prepared as described in Example 1 to form a fiber pulp slurry.

Example 3

Preparation of Composite from Fiber Pulp

After processing the feather waste stream as in Example 1, place one pound of fiber into a Hollander beater containing about 0.5 ml Tween in 20 gal water and beat the fiber for 3 hrs. The beaten fiber pulp slurry is collected. [OPTION:

treat the fiber with hydrogen peroxide to further whiten the fibers and enhance the pulp-like properties of the fiber.] Dry the sample overnight in a forced-air oven at 105 degrees C. Beat about 8 g dried feather fiber pulp with 2 g kenaf, 0.5 g casein glue solution and 300 ml water in a Waring-type blender for 5 min. Pour the pulp slurry onto a thin 12"×12" polyethylene plastic sheet overlaid onto an 11"×11"×¼" plexiglass plate. Spread the slurry evenly over the polyethylene sheet with a spatula and tamp evenly with a 12"×1"×½" straight edge. Air dry the slurry overnight. Spray a mist of ethanol onto the sheet, and then dry the sheet under about 0.5–10 ton pressure per square inch in a hydraulic press between two polyethylene lined plexiglass sheets. Remove the polyethylene from the product, a flat composite sheet of feather/kenaf fiber.

Example 4

Preparation of Filters from Fiber Pulp

After processing the feather waste stream as in Example 1, place one pound of fiber into a Hollander beater containing about 0.5 ml Tween in 20 gal water and beat the fiber for 3 hrs. The beaten fiber pulp slurry is collected. [OPTION: treat the fiber with hydrogen peroxide to further whiten the fibers and enhance the pulp-like properties of the fiber.] Dry the sample overnight in a forced-air oven at 105 degrees C. Make a a feather-fiber filter by forming a fully dispersed mixture of feather fiber (ca 0.5–1.0 cm) and polyethylene fibers (5 mm long×0.1 mm O.D.) into flat cylindrical shapes (5.5 cm diameter, 1.5 cm thick) and heating at 130 degrees C. for two hours. The resulting fiber wafer is supported on the flat surface of a funnel sieve plate.

Example 5

Preparation of Insulation from Fiber Pulp

After processing the feather waste stream as in Example 1, select the quality of insulating feather fiber from one or more of the various types of separters to meet insulation specification. Place one pound of fiber into a Hollander beater containing about 0.5 ml Tween in 20 gal water and beat the fiber for 3 hrs. The beaten fiber pulp slurry is collected. [OPTION: treat the fiber with hydrogen peroxide to further whiten the fibers and enhance the pulp-like properties of the fiber.] Dry the sample overnight in a forced-air oven at 105 degrees C. as in example 4. Make insulation by, but not limited to, blowing feather fibers of any or specified length into structural voids, clothing, linings and acoustical dampers.

Example 6

Preparation of Wovens from Fiber

After processing the feather waste stream as in Example 1, textiles are produced by spinning feather fiber into threads which are subsequently woven into fabric using methods known to those skilled in the art.

Example 7

Preparation of Non-wovens

After processing the feather waste stream as in Example 1 or 4, fabrics are produced by a dry laid tangle of feather fiber alone or a mixture of feather fiber with other fibers. For added strength and support, the fiber tangle can be formed on a web into which the fibers tangle. Also, fabrics are produced by combining feather fiber and olefin fibers by fusing the different types of fibers together on a web passing under a press or nip heated to an olefin fiber melting temperature which does not exceed 230 degrees C. These methods are known to those skilled in the art.

Example 8

Preparation of Extrusions, Laminates, Composites

After processing the feather waste stream as in Example 1, as in Examples 1,2, and 3. several practices known to those skilled in the art, including extrusion, lamination and composition methods create objects from various feather-fiber pulp mixtures. These objects include, but are not limited to, containers, supports, sheathing, boat hulls, car bodies, furniture, termite barriers, and biodegradable materials for agriculture.

While the above examples describe procedures carried out by hand, mechanized procedures are preferable for mass production. Fiber and fiber pulp compositions may be utilized in these procedures with little or no modification.

Although specific forms of the invention have been selected for illustration in the drawing and the preceding description is stated in specific terms for the purpose of describing these forms of the invention, this description is not intended to limit the scope of the invention which is defined in the claims.

What is claimed is:

1. A process for converting components of a feather-waste stream to fiber, protein, and oil comprising the steps of:

(a) contacting with a solvent components selected from a group consisting of feathers and a mixture of feathers and avian parts from the feather-waste steam;

(b) maintaining contact of said components from the feather-waste stream with the solvent;

(c) drying said components from the feather-waste stream;

(d) shredding and comminuting said components from the feather-waste stream; and (e) classifying the shredded and comminuted said components from the feather-waste stream.

2. The process of claim 1 in which the contacting and maintaining steps are performed only one time.

3. The process of claim 1 which further comprises collecting a fluid produced during the maintaining step comprising solvent, protein and avian oil and separating the fluid to obtain segregated products of solvent, protein, and avian oil.

4. The process of claim 1 in which the contacting and maintaining steps comprise continuous counterflow extraction in which the feather-waste stream flows in one direction from a zone of initial contact with the solution and a stream of the solution flows oppositely to the feather-waste stream.

5. The process of claim 4 which further comprises extracting a liquid component from the feather-waste stream during the continuous counterflow extraction, and mixing the liquid component with the solution to produce an increasing concentration gradient of solvent in the stream of solution in said one direction.

6. The process of claim 5 which further comprises keeping the solvent in the stream of solution in the zone of initial contact at a preselected dilute concentration in the range of about 65–75 vol %.

7. The process of claim 6 in which the keeping step comprises charging a concentrate solution of the solvent into the stream of solution at a solvent feed point distant from the zone of initial contact and in which the solvent in the concentrate solution is in the range of about 80–95 vol %.

8. The process of claim 4 which further comprises filtering fine particles of insoluble protein from the feather-waste stream in the zone of initial contact.

9. The process of claim 7 in which the average residence time of contact of the feather-waste stream with the solution in the zone of initial contact is about 10 minutes to 1 hour and in the 80 to 95% vol zone is about 10 minutes to one hour.

10. The process of claim 1 which further comprises the step of classifying the segregated fiber into a plurality of fractions characterized by different average fiber lengths.

11. The process of claim 10 in which one fraction of fiber has a fiber length in the range of about 40 microns to about 5 cm.

12. The process of claim 1 in which the water soluble organic solvent is selected from the group consisting of alcohols, ketones, and esters having from 1 to 7 carbon atoms, and mixtures thereof.

13. The process of claim 12 in which the water soluble organic solvent is an alcohol selected from the group consisting of methanol, ethanol, propanols, butanols, pentanols, hexanols, heptanols, octanols, nonanols, decanols, and the like or mixtures thereof.

14. The process of claim 4 in which solvent is reclaimed and reused in the vessel wherein counterflow takes place.

15. Fibers derived from a feather-waste stream, wherein said fibers are prepared according to a method comprising (a) contacting with a solvent said components selected from a group consisting of feathers and a mixture of feathers and avian parts from the feather-waste steam;

(b) maintaining contact of said components from the feather-waste stream with the solvent;

(c) drying said components from the feather-waste stream;

(d) shredding and comminuting said components from the feather-waste stream; and (e) classifying the shredded and comminuted components from the feather-waste stream, said fibers having been subjected to treatment to render them soft and pliable, wherein said treatment is beating or chemical treatment with redox reagents.

16. A method of making fiber pulp, said method comprising mixing fibers derived from a feather-waste stream with an amount of water or wetting agents or a mixture thereof effective for the preparation of said fiber pulp, wherein said fibers are prepared according to a method comprising:

(a) contacting with a solvent components selected from the group consisting of feathers and a mixture of feathers and avian parts from the feather-waste steam;

(b) maintaining contact of said components from the feather-waste stream with the solvent;

(c) drying said components from the feather-waste stream;

(d) shredding and comminuting said components from the feather-waste stream; and (e) classifying the shredded and comminuted components from the feather-waste stream.

17. A composition comprising fibers derived from a feather-waste stream and one or more additives, wherein said fibers are prepared according to a method comprising:

(a) contacting with a solvent components selected from the group consisting of feathers and a mixture of feathers and avian parts from the feather-waste steam;

(b) maintaining contact of said components from the feather-waste stream with the solvent;

(c) drying said components from the feather-waste stream;

(d) shredding and comminuting said components from the feather-waste stream; and (e) classifying the shredded and comminuted components from the feather-waste stream.

18. The composition of claim 17, wherein said additives are selected from a group consisting of adhesives, bonders, sizing agents, dyes, mordants, fillers, plant fibers, animal fibers, and whiteners.

19. A composition comprising fiber pulp, wherein said fiber pulp comprises fiber derived from a feather-waste stream and water or wetting agents or a mixture of water and wetting agents and wherein said fibers are prepared according to a method comprising:

(a) contacting with a solvent components selected from a group consisting of feathers and a mixture of feathers and avian parts from the feather-waste steam;

(b) maintaining contact of said components from the feather-waste stream with the solvent;

(c) drying said components from the feather-waste stream;

(d) shredding and comminuting said components from the feather-waste stream; and (e) classifying the shredded and comminuted components from the feather-waste stream.

20. The composition of claim 19 wherein said composition additionally comprises additives selected from a group consisting of mordants, dyes, binders, foaming agents, hardeners, chemical sizing agents, fillers, plant fibers, and animal fibers.

* * * * *